United States Patent [19]

Horvath

[11] 3,987,891

[45] Oct. 26, 1976

[54] MOISTURE PROOF SAFETY CONTAINER FOR PILLS AND THE LIKE

[75] Inventor: William Horvath, Watchung, N.J.

[73] Assignee: Plastic Research Products, Inc., Warren, N.J.

[22] Filed: July 7, 1975

[21] Appl. No.: 593,319

[52] U.S. Cl. ..... 206/1.5; 220/347

[51] Int. Cl.[2] ..... B65D 43/20; B65D 55/02

[58] Field of Search ..... 206/1.5; 220/346, 347

[56] References Cited

UNITED STATES PATENTS

| | | | |
|---|---|---|---|
| 447,984 | 3/1891 | Theuerner | 206/1.5 |
| 889,568 | 6/1908 | Albrecht | 206/1.5 |
| 1,163,773 | 12/1915 | Ross | 206/1.5 |
| 1,163,775 | 12/1915 | Rouse | 206/1.5 |

FOREIGN PATENTS OR APPLICATIONS

| | | | |
|---|---|---|---|
| 124,581 | 9/1931 | Austria | 206/1.5 |

*Primary Examiner*—Leonard Summer
*Attorney, Agent, or Firm*—Martha G. Pugh

[57] ABSTRACT

A moisture proof safety container for pills and the like in which a drawer moves slidably in a rectangular cover, snap-locking closed by means of a latching mechanism comprising a hooked tongue which engages a small window in the upper left-hand corner of the cover. The drawer, including the hooked tongue, is guided into latching position with the cover by means of a fulcrum point located on the inside of the cover which bears against one side of the drawer. When the drawer is closed a small projection at the center of the cover seats on the bottom of the drawer, cooperating with a small bead around the rim of the drawer, and small feet in the corners, to produce a moisture proof seal.

11 Claims, 17 Drawing Figures

MOISTURE PROOF SAFETY CONTAINER FOR PILLS AND THE LIKE

BACKGROUND OF THE INVENTION

This invention relates in general to slide cover containers of the type for dispensing pills and the like; and, more particularly, to safety lock containers.

There is an extensive market for small, compact pill boxes designed for the pocket, purse or family medicine cabinet, which securely latch in a manner to protect the contents from spillage, access by small children or deterioration from exposure to the atmosphere. Many prior art containers of the type described require substantial finger strength and dexterity to open, even when the user follows written instructions. Other containers which open more readily, latch less securely and are, therefore, subject to spillage and moisture contamination.

SUMMARY OF THE INVENTION

Accordingly, a principal object of this invention is to provide an improved container for pills and the like which securely latches closed, but which quickly snaps open when operated by the user in response to simple instructions.

Another object of the invention is to provide a container which protects the contents from moisture and other atmospheric contaminants.

These and other objects are realized in the moisture proof safety container of the present invention which comprises a drawer designed to move slidably in a rectangular cover and including a latching mechanism comprising a small hooked tongue on the inside upper corner of the drawer which is constructed to engage and lock into a small window in a correlated position on the back wall of the cover.

In one embodiment of the invention, a projection, centered on the inside floor of the cover, engages a shallow rectangular track centered on the bottom surface of the drawer, which extends from a slight abutment at one end near the inside rear wall of the drawer to a slight incline at the other end, near the center. As the drawer snaps into locked position with the cover, the projection on the floor of the cover overrides the incline near the center of the drawer and seats in a dimple just beyond the incline. The latching operation is also facilitated by a fulcrum on the inner wall of the cover opposite the latching mechanism. This fulcrum functions to nudge the drawer in the direction of the window, so that the bevelled edge of the hooked tongue is pressed against a rounded interior flange adjacent one side of the interior, forcing the flange into engagement with a slot beneath the tongue. A rectangular scored surface centered on the bottom of the drawer near its front edge engages a rectangular cut-out in the floor of the cover when the drawer is locked into the cover.

To open the latch, the container is held in the left-hand, with opposite walls near the rear end of the cover compressed between the thumb and fingers. The left thumb presses a raised arrow, thereby forcing an internal pressure point against the side wall of the container adjacent the latch, forcing the tongue out of engagement with the small window. Simultaneously, the thumb on the right hand presses down on the top of the cover at its open end while the fingers engage the rectangular scored area and pull the drawer forward. The drawer is prevented from pulling out completely, with possible spillage of the contents, when the projection on the bottom of the cover engages the abutment at one end of the track near the rear edge of the drawer.

Particular features of the container in accordance with the present invention are that it quickly and securely latches for carrying or storage purposes and is readily unlatched by a simple manual operation for dispensing purposes.

Another feature of the container of the invention is its moisture proof seal. This is provided by a small bead around the top rim of the drawer. When the container is latched, four small supporting feet, two at the front corners of the drawer and two in the rear corners of the cover, cooperate with the central projection point to seal the bead against the inside of the cover.

BRIEF DESCRIPTION OF THE DRAWINGS

These and other objects, features and advantages will be apparent to those skilled in the art from a study of the drawings with reference to the detailed description hereinafter.

DETAILED DESCRIPTION

Figure 1:
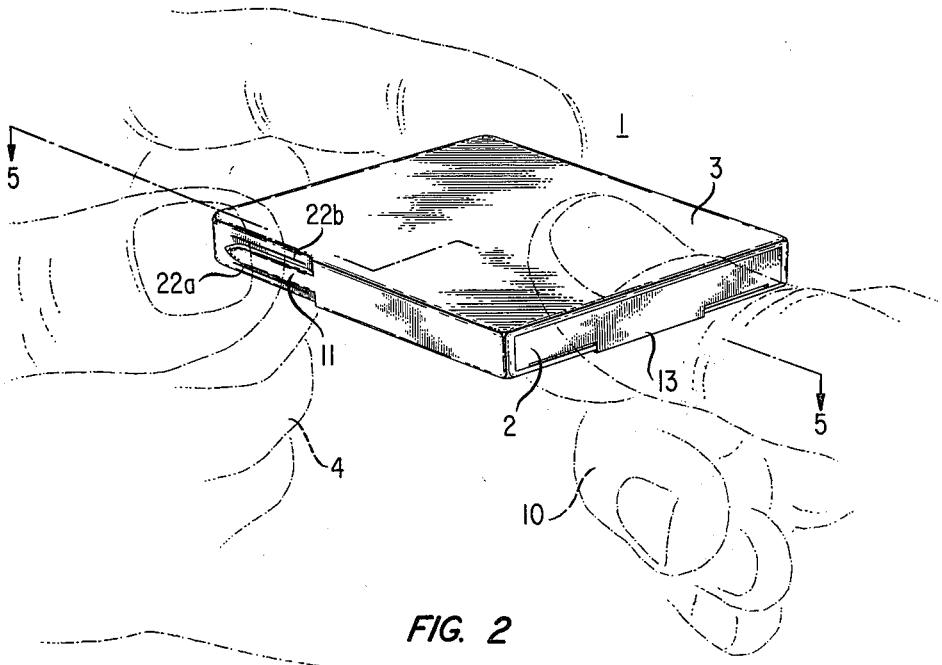
FIG. 1 shows the container of the present invention perspective, in latched-closed position, in the hands of a user poised to open the container.
Figure 2:
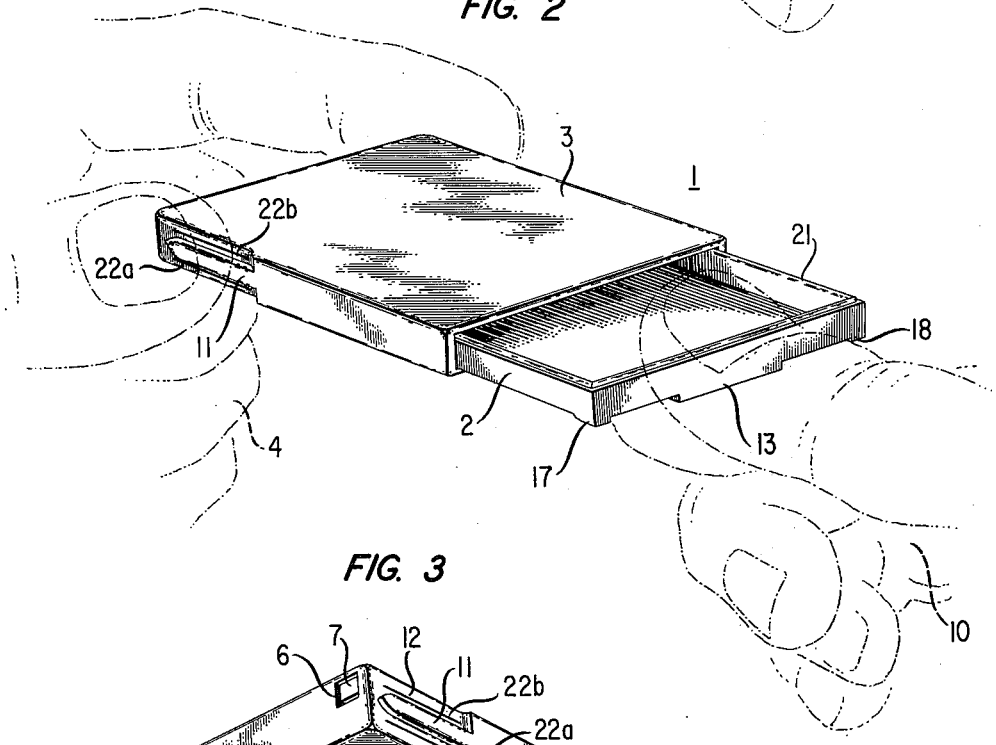
FIG. 2 shows the container of the present invention in perspective, opened to dispensing position.

Referring to FIGS. 1 and 2, there is shown a container 1 in accordance with the present invention which in overall dimension in the embodiment under description is 2 inches long, 1.596 inches wide and 0.4 inch deep, and may be formed of polyethylene or polypropylene or other plastic materials well-known in the art, such as, for example, polystyrene, acrylonitrile-butadiene-styrene, materials known by the trademarks Celcon (Celanese Corporation) and Delrin (E. I. DuPont de Nemours and Co., Inc.) and copolymers of any of the foregoing; or, in fact, any thermoplastic or thermosetting materials known in the art which are adapted to be molded or otherwise formed into a semirigid shape. Although it will be understood that wood, sheet metal and pressed paper products and equivalent materials may also be used for fabrication of safety containers in accordance with the present invention, in the event that a moisture seal is desired, materials are employed which are not pervious to moisture, such as, for example, polyethylene, polypropylene or their copolymers. In the present embodiment, the typical wall thickness of the body is 0.04, although it will be understood that in each case the thickness of the sheet material to be used will be determined by its strength and flexibility.

Figure 6:
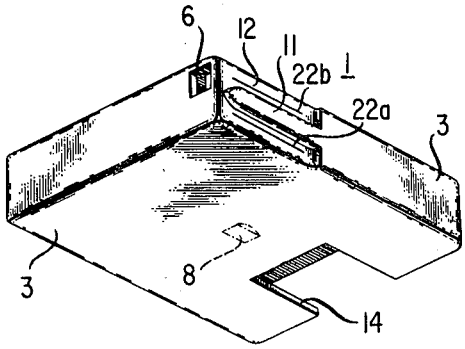
FIG. 6 is a rear view, in perspective, of the cover similar to the showing of FIG. 3, with the drawer removed.
Figure 7:
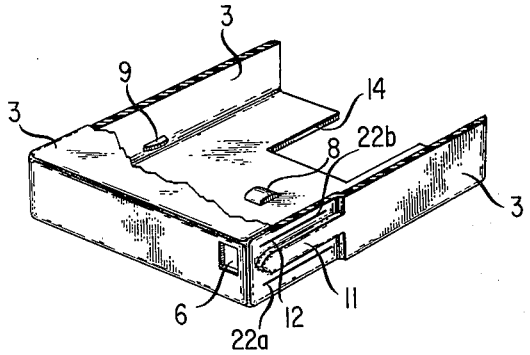
FIG. 7 is a view, in perspective, looking from above to the inside of the cover of FIG. 6, with the top partly broken away.
Figure 8:
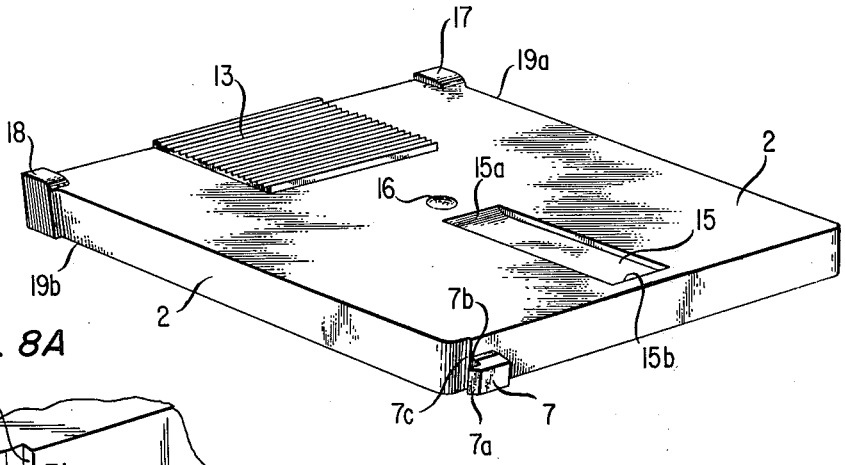
FIG. 8 is a perspective view of the drawer, looking at the bottom.
Figure 9:
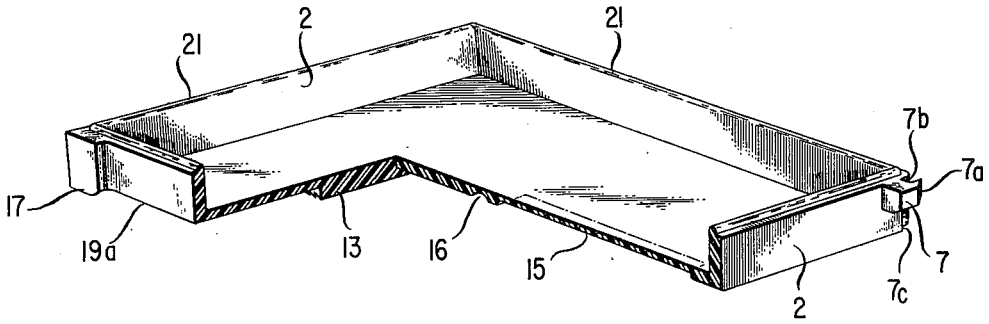
FIG. 9 is a view, in perspective, of the inside of the drawer of FIG. 8, looking down from the top and partly broken away to show the back, one side wall and the floor in section.

The drawer 2, which is described in detail in FIGS. 8 and 9, slidably engages a rectangular cover 3, which is described in detail in FIGS. 6 and 7. The cover 3 is open only at the front end and closed at the top, bottom and on the other three sides.

As shown in FIGS. 1 and 2, in order to open the container 1, the user holds one end in his left hand 4, pressing the thumb against the embossed pointer 11, molded into the rear end of one side, and pressing the opposite side with the fingers of the same hand. Simultaneously, the thumb of the right hand 10 presses down on the top of the cover 3, while the fingers pull the drawer 2 forward, releasing the same.

Figure 3:
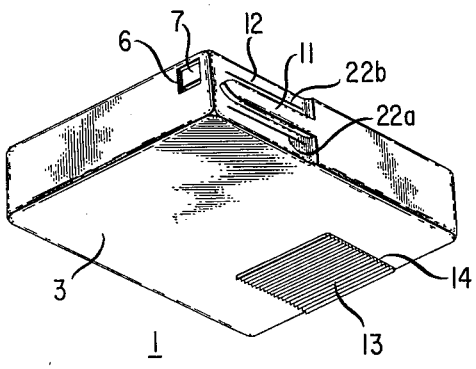
FIG. 3 is a view, in perspective, looking from below at the rear end of the container of the present invention in latched-closed position.

FIG. 3 is a perspective view, looking up from the bottom of the container 1 in completely latched condition, showing the rectangular scored area 13 at the bottom of the drawer 2, which protrudes slightly below the rectangular cut-out 14 in the bottom of the cover 3, in order to assist the user in pulling the drawer 2 forward. The scored area 13 on the bottom of drawer 2 is substantially square, 0.6 inch on a side, and is centered in abutting relation to the outside edge. The cut-out 14 is dimensioned to just accommodate scored area 13 when the drawer 2 is closed.

A salient feature of the present invention is the novel latch which includes a small window 6 in the upper left-hand corner of the cover 3, which is engaged by a flat hooked tongue 7 protruding from the upper left-hand corner of the drawer 2. This is shown more clearly in enlarged detail in FIG. 4, in which the top of the cover 3 has been cut away for clarity. Although for the purposes of illustration the present container has been shown with the window in the upper left-hand corner of the cover, it will be understood that the window can be located in the middle, right-hand side or any other place by changing the position of fulcrum 9 accordingly. (See FIG. 7).

In the present embodiment, the top perimeter of the window 6 is located 0.04 inch down from the top and 0.06 inch in from the left-hand corner edge, with the container oriented as shown in FIG. 1. The window opening extends 0.135 inch in a horizontal direction and 0.13 inch vertically, the wall thickness being 0.04 inch. Adjacent the inner vertical edge of the window, nearest the corner, is a small vertically extending flange 6*a* which is 0.03 inch wide and about 0.03 inch thick, forming a substantially rectangular step with the edge of the window, but rounded on its inner surface, forming a partially cylindrical contact area having a radius of 0.03 inch in cross-section.

Figure 4:
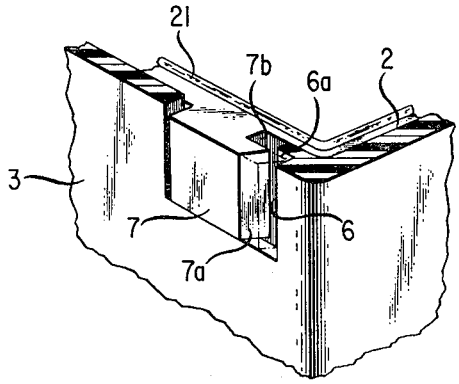
FIG. 4 is an enlarged fragmentary showing of the container of FIG. 1, in perspective with the cover cut away to show the latching mechanism.

The hooked tongue 7 is on the corresponding rear left-hand corner of the drawer 2. (See FIG. 4). Hooked tongue 7 is substantially rectangular on top, about 0.1 inch square, protruding out about 0.04 inch from the rear outer wall of the drawer 2. The left-hand edge of tongue 7 is substantially rectangular, whereas the right-hand edge is bevelled at a 60° angle with the flat front surface. The flanged inner edge of 7a is undercut to provide a vertically extending slot 7*b* about 0.03 inch wide to just accommodate the vertical flange 6*a* of the window 6, to secure the latch (FIG. 4). Aligned with the slot 7*b* is a slight set-back 7*c* in the thickness of the end wall of drawer 2, to permit the corner of the drawer to fit more snugly into the corner of the cover 3 when the two are in latched relation. (See FIGS. 8, 8A and 9.) The bottom edge of hooked tongue 7 is bevelled at a slight angle to the horizontal to facilitate latching. The specific elements of the latching mechanism are shown schematically in greater detail in FIGS. 11, 11A and 12, 12A of the drawings.

Figure 5:
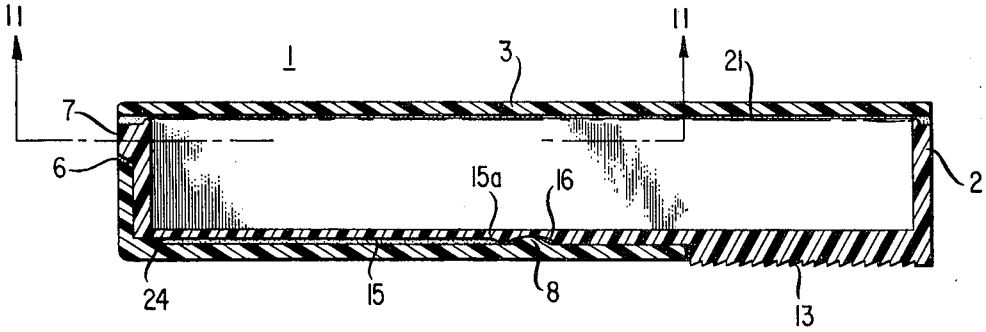
FIG. 5 is a longitudinal sectional view along the plane indicated by the arrows 5—5 of FIG. 1, indicating the drawer in latched position in the cover.

FIG. 5 is a sectional showing, taken along a longitudinal center plane 5—5 of FIG. 1, which gives a better understanding of the operation of the locking mechanism, showing the drawer 2 in locked engagement with the cover 3. This shows the hooked tongue 7 in engagement with the window 6. In order to guide the hooked tongue 7 into position and to secure it in locked relation to window 6, a small projection 8 protrudes upwardly from a position near the center of the floor of the cover 3, (see FIG. 7.)

Describing the cover 3 in detail, reference is made to FIG. 6, which is an external view from the bottom, and FIG. 7, which is a view looking in from the top which is shown partly broken away. Projection 8 is located on the centerline 0.93 inch from a line parallel to the front edge and extending 0.1 inch from front to back, and 0.16 inch across. The fulcrum 8 is rounded, characterized by a gradual incline from the front end to a maximum height of about 0.02 inch above the floor, abruptly declining at its rear face to provide a stop, as will presently be described.

Figure 13:
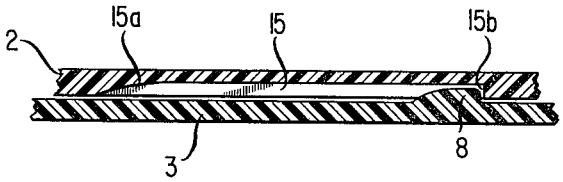
FIG. 13 is a detailed fragmentary showing of a cross-section of the projection 8 in engagement with the abutment 15*b* when the drawer is in dispensing position, as shown in FIG. 2.
Figure 12A:
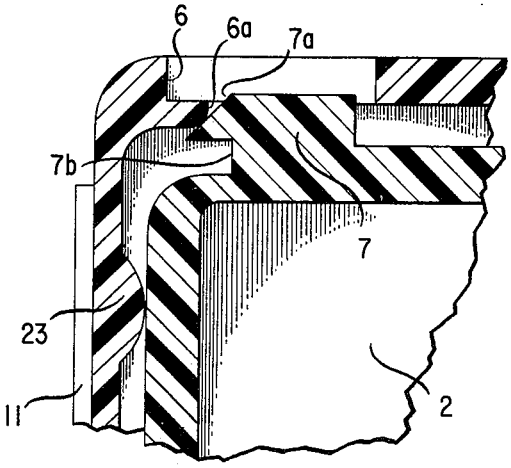
FIG. 12A is an enlarged planar sectional detail of the latching combination shown in FIG. 12 in prelatched position to more clearly show the shape of the parts.

(See FIG. 13.) In closed position of the container, projection 8 also functions as a seal support, as will be further described hereinafter.

As previously set forth, cut-out 14 is centered at the front end and is 0.605 inch square to accommodate the scored area 13 of the drawer.

Opposite projection 8 on the right-hand inner side wall on cover 3 is a fulcrum point 9, disposed close to the floor of the cover, with its abrupt front face about one inch from the open end. Fulcrum 9 is shaped like a tear drop, protruding about 0.1 inch from the wall adjacent its abrupt front face and inclined gradually for about ¼ toward the back. (See FIGS. 11, 11A and 12, 12A).

The pointer 11, previously described, is embossed on the outside of the cover 3 to direct the user to the proper pressure area for opening the container 1, as shown in FIG. 1. In the present embodiment, the pointer 11 is about ⅛ inch wide and ¾ inch long, the end being pointed toward the window 6. The side walls above and below the pointer 11 are slightly recessed, containing a pair of slits 22*a* and 22*b*, substantially colinear with and extending along opposite sides of the embossed pointer 11. On the inside wall of the cover 3, located adjacent the outer end of pointer 11 is a slightly raised contact point 23 (see FIGS. 11 and 12). A diaphragm-effect is produced when the pointer 11 is pressed, tending to flex the wall of the cover 3 so that contact point 23 presses on the side wall of drawer 2, tending to dislodge the hooked tongue 7 from latching relation with the flange 6*a* of window 6.

Figure 8A:
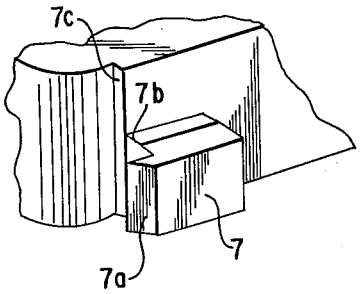
FIG. 8A is an enlarged detail of the front corner of FIG. 8.
Figure 10B:
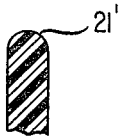
FIGS. 10A and 10B are fragmentary sectional showings of possible variations in cross-section of bead 21.
Figure 10A:
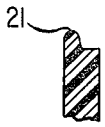
Figure 12:
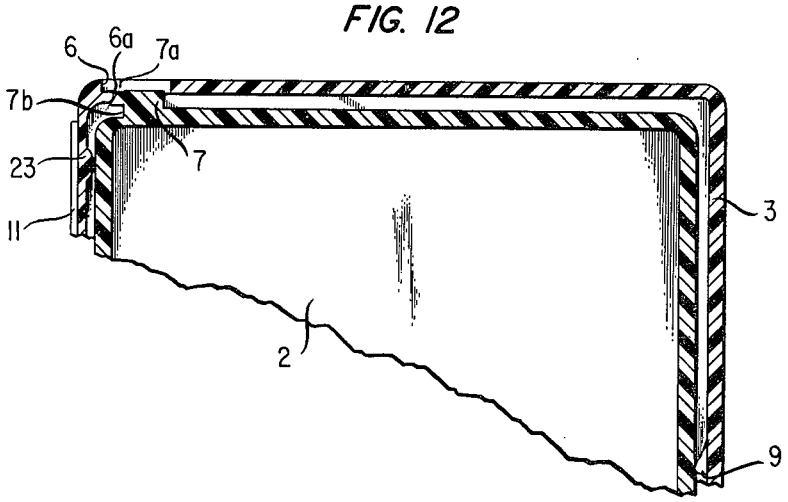
FIG. 12 is a detailed fragmentary view, similar to FIG. 11, showing tongue 7 in prelatched position in relation to the window 6.

FIGS. 8, 8A and 9 show the drawer 2 in greater detail, upended in FIG. 8 and partially sectioned in FIG. 9. FIG. 8A is an enlargement of the front corner to show greater detail. In the present embodiment, the drawer 2 is 1.96 inches in overall length, 1.51 inches in overall width and 0.305 inch deep, except for a pair of small feet 17 and 18 at the front lower corners which are about 0.02 inch square. The latter serve to make the drawer 2 fit more snugly in the cover 3. A corresponding pair of feet, the same height and extent as 17 and 18, are disposed in the inside lower corners of cover 3. Note 24 on the cross-sectional view of FIG. 5. A rounded lip or bead 21 extends all around the upper inside edge of the drawer 2 to act as a moisture seal. The lip or bead 21 may take either of the forms indicated in FIGS. 10A or 10B, although the larger lip shown in 10B, having a radius of about 0.20 inch, is preferred. The four supporting feet 17, 18, 24 and 25 (not shown) and the projection 8 serve to force the bead 21 on drawer 2 into moisture proof sealed relation with the inside of cover 3, when the container 1 is latched.

The projection 8 on the floor of cover 3 is constructed to ride in an elongated rectangular track 15, which is 0.78 inch long, 0.2 inch wide and 0.015 inch deep, extending from an abutment located 0.13 inch behind the lateral centerline to 0.65 inch from the inside edge of the drawer 2. (See FIG. 8.) The inner end 15*a* of track 15 is inclined, whereas the abutment 15*b* near the outer edge is abrupt and rectangular, providing a stop which engages the abutting face of projection 8, serving to limit the extent to which drawer 2 opens in dispensing position, thereby preventing spillage. (See FIG. 13.) Beyond the inclined plane 15*a* at the inner end of track 15 is a dimple 16 having a 0.04 inch radius. When the drawer and the cover are in closed, latched relation, the projection 8 seats in the dimple 16, thereby serving, together with feet 17, 18, 24 and 25, to force drawer 2 upward, so that the lip 21 engages the inside of the cover in moisture proof sealed relation.

The container 1 operates as follows in the hands of a user. The projection 8 engages and rides in track 15. When the drawer 2 moves into locked engagement with cover 3, the inclined surface of projection 8 rides up on and overrides the inclined plane 15*a* at the inside end of the track 15 and reposes in the dimple 16, forcing the container into moisture proof sealed relation with the inside of the cover. The function of the side wall fulcrum 9 is to force the drawer 2 towards the left-hand corner of the cover 3 as it rides forward on the track 15, so that the hooked tongue 7 is forced into and retained in latching relation with the small window 6.

Figure 11:
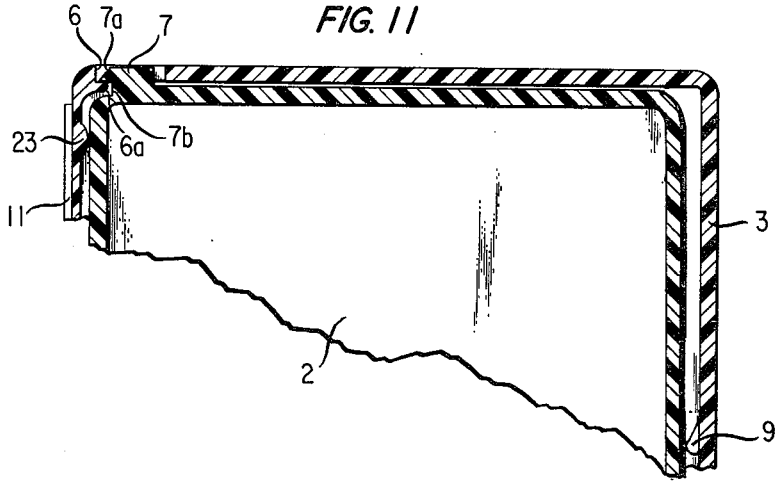
FIG. 11 is a detailed fragmentary view of the rear half of the container of FIGS. 1, et seq., in planar section, as indicated by the arrows of FIG. 5, showing the hooked tongue 7 in latched position in the window 6.
Figure 11A:
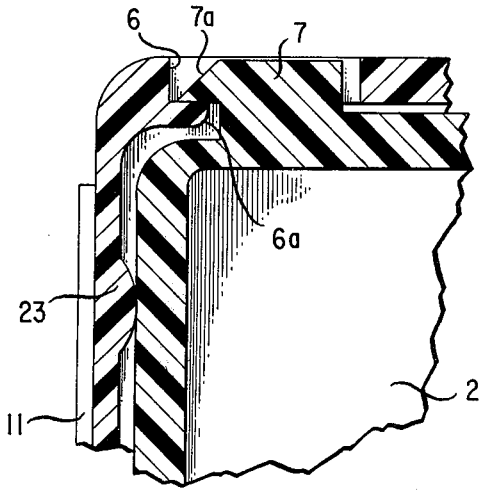
FIG. 11A is an enlarged planar sectional detail of the latching combination of FIG. 11 in closed position.

Referring to FIGS. 11, 11A and 12, 12A, it is seen that the inwardly directed rounded contact area of flange 6*a* engages and is pressed against the bevelled surface 7*a* of the hooked tongue 7, contacting it in a tangential relation, and forcing the hooked tongue 7 into locked engagement with flange 6*a*, as shown in FIGS. 11 and 11A.

When the rear ends of the container 1 are compressed between the left-hand thumb and fingers of the user to open the drawer 2, as illustrated in FIG. 1, the pointer 11 is pressed inwardly. The slits 22*a* and 22*b* tend to produce a diaphragm effect, flexing the wall of the cover 3 so that contact point 23 makes instant contact with the side wall of drawer 2 at a single point. This tends to push the drawer 2 laterally, causing the tongue 7 to disengage its slot 7*b* from the window flange 6*a*, thereby releasing the latch. This operation is assisted by the fact that when the left-hand end of drawer 2 is nudged laterally, it tends to rotate clockwise in a horizontal plane about the fulcrum 9.

The drawer 2, is then free to slide open to dispensing position, with the projection 8 riding in track 15. When the abutment 15*b* engages the abrupt rear wall of the projection 8, this acts as a stop, limiting the opening of the drawer 2 and retaining it in dispensing position so that a limited amount of pills or other contents are released into the hands of the user without spillage.

The side walls of the drawer 2, adjacent the front ends 19*a* and 19*b*, are approximately 0.04 inch thick, to a plane about 1/16 inch from the front, where the thicknesses of the walls on both sides are cut back to 0.02 inch, continuing uniformly at this thickness to the back wall. Together with the operation of the four feet 17, 18, 24 and 25 (not shown) and the bead 21, all of these features cooperate to render the container substantially moisture proof when in latched position.

It will be understood that the details and specific dimensions of the described embodiment are for the purposes of illustration only; and, the invention is not to be construed as limited, except by the scope of the appended claims.

What is claimed is:

1. A substantially rectangular container comprising in combination:

a cover having a rear wall and at least two side walls and open at the front, a drawer constructed to move slidably into and out of the open front of said cover, means for securing said drawer in latched relation with said cover comprising a window disposed in the back wall of said cover, and a hooked tongue on the rear wall of said drawer constructed to fit into and substantially close said window, said hooked tongue having an edge portion constructed to engage a mating edge on said window in latching relation.

2. The combination in accordance with claim 1 wherein said window is adjacent a rear corner of said cover, and said hooked tongue is disposed near a corresponding rear corner of said drawer.

3. The combination in accordance with claim 2 in which said cover comprises a floor, a projection protruding near the center of said floor, a shallow track formed on the bottom of said drawer and extending centrally from an inclined portion near the middle of the bottom to an abrupt abutment near the rear of said drawer, said projection being constructed to engage and ride in said track when said drawer slides into said cover overriding said inclined portion at the inner end of said track, and to engage said abrupt abutment when said drawer slides out of said cover to assume a dispensing position.

4. The combination in accordance with claim 3 in which said floor includes a depression comprising a dimple aligned with and adjacent to the inner end of said track, wherein said projection is constructed to seat in said dimple when said drawer overrides the inclined portion of said track, tending to support and maintain said drawer in sealed relation with said cover.

5. The combination in accordance with claim 4 which comprises a plastic bead extending around the upper periphery of said container, four substantially similar supporting feet, two attached to the bottom corners of said drawer and two disposed in the lower rear inside corners of the said cover, said feet constructed to cooperate with said central floor projection to support said drawer so that the bead on said drawer makes substantially moisture proof engagement with said cover when said drawer and said cover are in latched engagement.

6. The combination in accordance with claim 2 comprising:

a fulcrum member protruding from a position near the center of the inner side wall of said cover opposite the corner adjacent said window, said fulcrum member constructed to engage the adjacent side wall of said drawer as said drawer moves into closed relation with said cover, whereby pressure against the outer end of said drawer creates a torque about said fulcrum moving said drawer in the direction of said rear corner and tending to force said hooked tongue into latching relation with said window.

7. The combination in accordance with claim 6 wherein the upper side wall of said cover adjacent said window comprises an embossed external pressure area for compression by the user, the thickness of the said side wall adjacent said embossed pressure area having been reduced to provide flexibility, and an internally directed raised pressure point adjacent said embossed pressure area for instantly communicating pressure applied by said user to the pressure area on said cover to the lateral wall of said drawer adjacent said hooked tongue for applying a torque about said fulcrum which tends to disengage said tongue from said window.

8. The combination in accordance with claim 7 which includes a pair of slits substantially colinear with said embossed pressure area for increasing the flexibility of the side wall.

9. The combination in accordance with claim 2 wherein said window is rectangular with a vertically extending flange along an inner edge at one side, and said hooked tongue has a rectangular head precisely shaped to fit snugly into and substantially close said window, said hooked tongue having a bevelled face along one vertical edge to form an overhanging projection which is undercut along its inner vertical edge to form a slot which just accommodates the vertically extending flange of said window when said tongue is in latched relationship with said window.

10. The combination in accordance with claim 9 wherein the outer face of said vertically extending flange adjacent the edge of said window is substantially flat, terminating in a right angular corner conforming to the shape of said slot, the inner face of said flange being rounded and constructed and arranged to provide a contact surface in the path of the bevelled face of said hooked tongue as said drawer slides into said cover, whereby the pressure of said bevelled face on said round contact surface in response to the thrust provided by said fulcrum member tends to move said hooked tongue into latching relation with the outer face of said flange.

11. The combination in accordance with claim 3 wherein said window does not exceed in lateral extent about one-eighth the width of the rear wall of said cover.

* * * * *

UNITED STATES PATENT AND TRADEMARK OFFICE

CERTIFICATE OF CORRECTION

PATENT NO. : 3,987,891

DATED : October 26, 1976

INVENTOR(S) : William Horvath

It is certified that error appears in the above-identified patent and that said Letters Patent are hereby corrected as shown below:

Column 2, line 23, after "invention" insert --, in--; line 26, after "invention" insert a comma; line 32, after "perspective" insert a comma; line 62, after "6;" cancel "and". Column 3, line 26, after "0.04" insert --inch--. Column 4, line 40, change the comma to a period, change "see" to --See--; line 52 does not start a new paragraph, but follows "described." in line 51; line 64, change "1/4" to --1/4 inch--.

Signed and Sealed this

Eleventh Day of January 1977

[SEAL]

*Attest:*

RUTH C. MASON
*Attesting Officer*

C. MARSHALL DANN
*Commissioner of Patents and Trademarks*